United States Patent [19]

Lapeyronnie

[11] 3,982,518

[45] Sept. 28, 1976

[54] ELECTRONIC IGNITION DEVICE FOR INTERNAL COMBUSTION ENGINES

[75] Inventor: André Gabriel Lapeyronnie, Paris, France

[73] Assignee: Fournitures Internationales de Materieles Electroniques, Paris, France

[22] Filed: Jan. 28, 1975

[21] Appl. No.: 544,935

Related U.S. Application Data

[62] Division of Ser. No. 298,025, Oct. 16, 1972, Pat. No. 3,905,347.

[30] Foreign Application Priority Data

Oct. 14, 1971 France ..... 71.36966

[52] U.S. Cl. ..... 123/148 CB; 315/209 CD

[51] Int. Cl.[2] ..... F02P 1/00

[58] Field of Search ..... 123/148 MC, 148 IC, 123/148 OC, 148 E; 315/209 CD

[56] References Cited

UNITED STATES PATENTS

| | | | |
|---|---|---|---|
| 2,461,321 | 2/1949 | Guillemin | 123/148 E |
| 2,985,797 | 5/1961 | Williams et al. | 123/148 IC |
| 3,045,148 | 7/1962 | McNulty et al. | 123/148 IC |
| 3,078,391 | 2/1963 | Bunodiere et al. | 123/148 IC |
| 3,134,048 | 5/1964 | Wolframm et al. | 123/148 IC |
| 3,234,430 | 2/1966 | Issler | 123/148 CB |
| 3,381,172 | 4/1968 | Weiner | 123/148 OC |
| 3,554,177 | 1/1971 | Hufton et al. | 123/148 MC |

*Primary Examiner*—Charles J. Myhre
*Assistant Examiner*—Ronald B. Cox
*Attorney, Agent, or Firm*—Steinberg and Blake

[57] ABSTRACT

The invention relates to an ignition system for an internal combustion engine, comprising a d.c.-d.c. converter coupled to the vehicle battery, a storage capacitor, an inductor, a thyristor, a delay line and an ignition transformer. The delay line operates as buffer storage means to prevent the storage capacitor and converter from being grounded during each ignition cycle, so that a plurality of abrupt, high voltage ignition pulses of predetermined width may be supplied to the ignition transformer from a battery with a low supply voltage, thus ensuring the engine starting in improved conditions.

3 Claims, 1 Drawing Figure

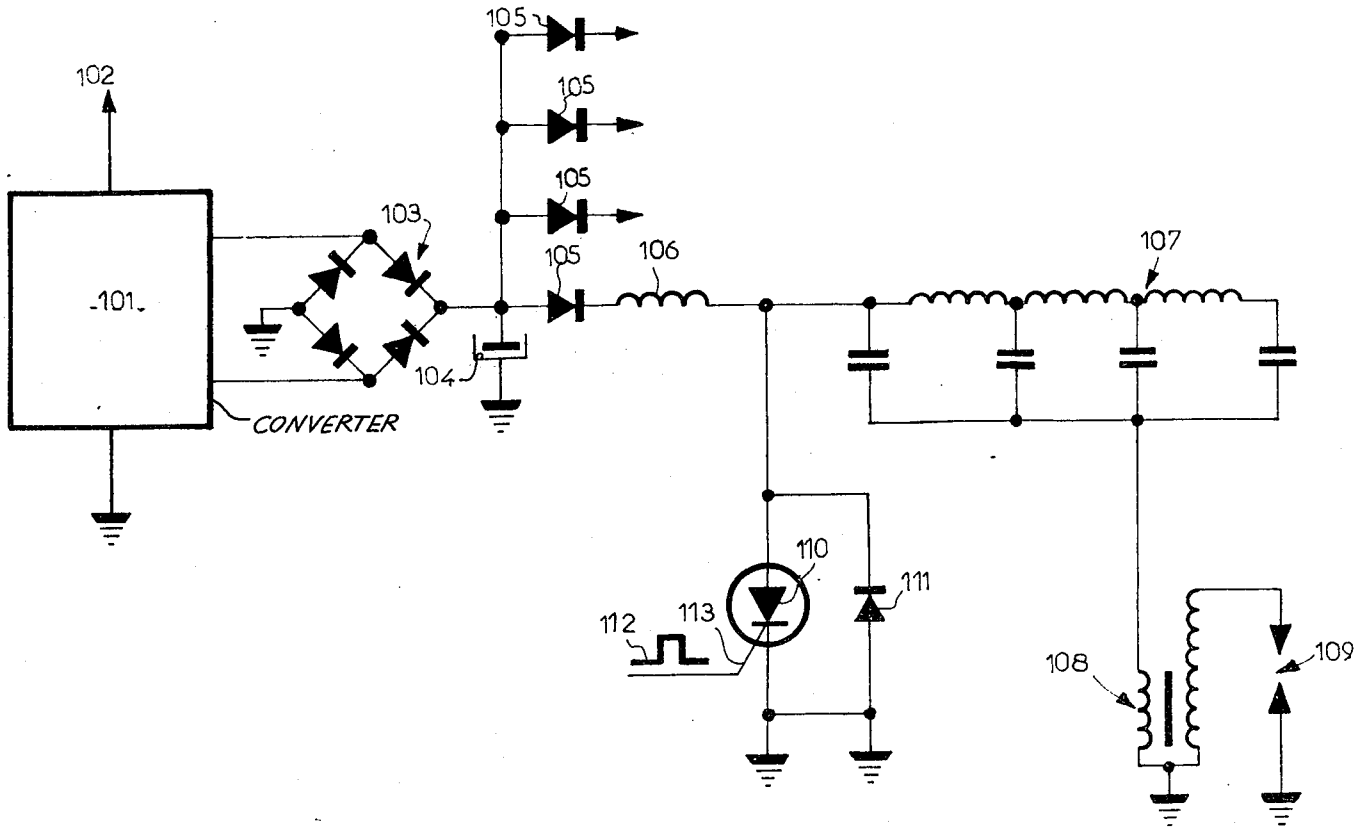
101
102
CONVERTER
103
104
105
105
105
105
106
107
108
109
110
111
112
113

ELECTRONIC IGNITION DEVICE FOR INTERNAL COMBUSTION ENGINES

This application is a divisional application of my pending application Ser. No. 298,025 filed on Oct. 16, 1972, now U.S. Pat. No. 3,905,347. It relates to an electronic ignition system for an internal combustion engine and, more particularly, to an improved power stage adapted to energize the plugs of the engine.

The requirements put forth by motor-car makers and, simultaneously, the new laws concerning the pollution caused by exhaust gases, are such that the ignition devices must meet highly stringent conditions, especially with respect to the duration of the spark provided to the plug, the value of the very high voltage supplied to this plug and its rising time. In order to obtain as good a combustion as possible, it has been necessary to determine the critical values for the duration of the spark, the value of the voltage applied to the electrodes of the plug, and of the rise time of this very high ignition voltage, all these values being such that the devices of the prior art are unable to withstand the corresponding stresses or to meet such requirements.

The invention obviates the drawbacks of the prior systems. In the drawings, the single FIGURE is a diagrammatic view of an exemplary embodiment of an ignition circuit implementing the principles of the present invention.

According to the embodiment shown in the FIGURE, each power stage associated with the plug corresponding to a cylinder is supplied by a converter 101 which converts the d.c. voltage provided by the battery 102 of the vehicle into a common a.c. voltage.

A rectifier bridge 103 formed of diodes is coupled to the output of the converter 101 in order to provide a d.c. voltage from the a.c. voltage supplied by the converter. An electrochemical capacitor 104 connects the output of the rectifier bridge 103 to the ground and a diode 105 in series relation with a choke 106 connects the output of the rectifier bridge 103 to a delay line 107 forming a buffer circuit. The coil 108 connects said delay line to a plug 109 mounted in the corresponding cylinder.

An active switching element, such as thyristor 110, is connected in parallel between the choke 106 and the delay line 107 and connects the power stage to a corresponding logic-circuit switching stage, not shown in the FIGURE. The cathode of said thyristor is grounded, its anode is connected to the power stage and its gate is connected to the switching logic-circuit. A diode 111, the direction of conduction of which is opposite to that of the thyristor 110, is connected in parallel with the latter between the ground and the anode of said thyristor.

The power stage described in the FIGURE operates as follows.

A pulse 112 delivered by the associated switching stage is supplied to the gate 113 of the thyristor. The latter then becomes conductive, and the voltage provided by the converter 101 and stored in the delay line 107 abruptly passes through the primary winding of the coil 108, during a time which is, precisely, determined by the delay line 107. The voltage induced in the secondary winding of the coil 108 produces a spark between the electrodes of the plug 109, the rising front of which is very steep and its duration well-determined.

At the end of the pulse 112, the thyristor 110 is non-conductive, the choke 106 serving to protect the converter for the duration of the pulse 112, preventing the latter from being grounded.

By way of example, the voltage provided by the battery 102 of the vehicle may vary between 7 and 15 volts, the d.c.-a.c. converter 101 supplying to the output of the rectifier bridge 103 a voltage on the order of 200 volts, the diode 105 and the choke 106 then forming a voltage doubler circuit enabling a voltage slightly lower than 400 volts to be obtained at the input of the delay line 107, so as to supply through the secondary winding of the coil 108 a very high voltage, higher than 15000 volts for a plug resistance of 50 k.ohms, with a rising time less than 5 microseconds. The duration of the spark between the electrodes of the plug is then greater than 0.4 milliseconds, corresponding to a spark energy on the order of 500 millijoules, i.e. an energy about 20 times greater than those obtained in the known devices of the prior art.

The converter used supplies the coil with a relatively high d.c. voltage, much higher than the d.c. voltage usually supplied to the said coil, thus enabling to obtain, at the plugs, spark energies much greater than those provided by the devices of the prior art.

Moreover, the use of the coil 108 enables notably leakage and stray capacity to be reduced, thus allowing a very tight coupling and an improved aptitude to transient states to be ensured.

Of course, the invention is by no means limited to the forms of embodiment described and illustrated, which have been given by way of example only. In particular, it comprises all the means constituting technical equivalents to the means described as well as their combinations, should the latter be carried out according to the spirit of the invention.

What is claimed is:

1. In an electronic ignition system for an internal combustion engine, a spark plug, coil means having primary and secondary windings, said secondary winding being connected electrically to said spark plug, delay line means connected electrically to said primary winding of said coil means for storing a voltage to be transferred to said primary winding during an interval determined by said delay line means, said delay line means also forming a buffer circuit, converter means for converting the D.C. voltage of a battery to an A.C. voltage, said converter means having an output, rectifier bridge means connected to said output of said converter means for converting the A.C. voltage thereof to a D.C. voltage, said rectifier bridge means having an output where the latter D.C. voltage is available, a diode and a capacitor means both connected to said output of said rectifier bridge means, said capacitor means being grounded for connecting the output of said rectifier bridge means to ground, a choke connected in series with said diode and said delay line means between the latter and said diode for transmitting the D.C. voltage available at said output of said rectifier bridge means to said delay line means to be stored thereby for transmission to said primary winding of said coil means, and an active switching means having an anode connected to a junction between said choke and delay line means, a cathode which is grounded, and a gate adapted to be connected with a switching logic circuit for receiving therefrom an activating pulse which renders said active switching means conductive to transmit the voltage stored by said delay line means to said primary winding of said coil means during a time determined by said delay line means.

2. The combination of claim 1 and wherein a diode whose direction of conduction is opposite to that of said active switching means is connected between ground and a junction between said anode and said junction between said choke and delay line means.

3. The combination of claim 1 and wherein said converter means and rectifier bridge means provide at the output of the latter a voltage on the order of 200 Volts when said converter means is connected to a battery having a capacity of between 7 and 15 Volts, said diode and choke forming a voltage doubler circuit providing from the voltage at said output of said rectifier bridge means a voltage on the order of 400 Volts to be stored by said delay line means and supplied to said coil means when said gate receives said activating pulse, said plug having a resistance on the order of 50 k.ohms while said coil means provides from the voltage received from said delay line means a voltage higher than 15,000 Volts for said plug with a rising time of less than 5 microseconds.

* * * * *

UNITED STATES PATENT AND TRADEMARK OFFICE

CERTIFICATE OF CORRECTION

PATENT NO. : 3,982,518

DATED : September 28, 1976

INVENTOR(S) : Andre Gabriel Lapeyronnie

It is certified that error appears in the above-identified patent and that said Letters Patent are hereby corrected as shown below:

In item [73] of the heading, the assignee should be indicated as: --Fournitures Internationales de Materiels Electroniques, "F.I.M.E."--.

Signed and Sealed this

Sixth Day of February 1979

[SEAL]

*Attest:*

RUTH C. MASON
*Attesting Officer*

DONALD W. BANNER
*Commissioner of Patents and Trademarks*